US005297340A

United States Patent [19]

Kahlcke

[11] Patent Number: 5,297,340

[45] Date of Patent: Mar. 29, 1994

[54] PARTING TOOL

[75] Inventor: Hartwig Kahlcke, Wiesbaden, Fed. Rep. of Germany

[73] Assignee: Hoechstmass Balzer GmbH, Fed. Rep. of Germany

[21] Appl. No.: 836,619

[22] Filed: Feb. 18, 1992

[30] Foreign Application Priority Data

Aug. 21, 1991 [DE] Fed. Rep. of Germany ..... 4127644

[51] Int. Cl.[5] ..... B26B 3/06

[52] U.S. Cl. ..... 30/155; 30/158; 30/161; 30/DIG. 8

[58] Field of Search ..... 30/294, DIG. 8, 153, 30/155, 161, 158, 330, 331, 332

[56] References Cited

U.S. PATENT DOCUMENTS

| | | | |
|---|---|---|---|
| 394,304 | 12/1888 | Schmitt | 30/161 |
| 533,219 | 1/1895 | Hardy | 30/158 |
| 689,513 | 12/1901 | Papendell | 30/158 |
| 2,710,448 | 6/1955 | Andrews | 30/162 |
| 3,972,117 | 8/1976 | Fogg | 30/287 |
| 4,040,181 | 8/1977 | Johnson | 30/161 |
| 4,660,284 | 4/1987 | Decarolis | 30/161 |
| 4,703,560 | 11/1987 | Brooker | 30/155 |

FOREIGN PATENT DOCUMENTS

| | | |
|---|---|---|
| 1093754 | 12/1960 | Fed. Rep. of Germany . |
| 3231934 | 3/1984 | Fed. Rep. of Germany . |

*Primary Examiner*—Richard K. Seidel
*Assistant Examiner*—Hwei-Siu Payer
*Attorney, Agent, or Firm*—Robert J. Koch

[57] ABSTRACT

A parting tool for parting seams and/or cutting threads or the like is disclosed. The parting tool may include an arc-shaped blade located between two tines of unequal length to effect a cut. The long tine may have a thorn-like point and the short tine may have a spherical thickening above the blade. The tines pass over into a shaft, which is fastened to one end of a shaft holder or mounting. The shaft mounting may include at its other end a pressure surface oriented perpendicularly to the blade and a rotation axle located at a defined distance in front of the pressure surface and oriented perpendicularly to the blade. The rotation axle may be rotatably supported in the lateral surfaces of a casing open within the rotation range of the shaft holder. A stop is provided within the casing for the shaft of the parting tool in the swivelled in, rest position. The stop may be a spring elastic element.

20 Claims, 5 Drawing Sheets

PARTING TOOL

BACKGROUND OF THE INVENTION

1. Field of the Invention

The invention relates to a parting tool for cutting seams, threads or the like, in particular, a parting tool with an arc-shaped blade located between two tines of unequal lengths to make a cut. The long tine has a thorn-like tip and the short tine a spherical thickening above the blade, and the tines pass into a shaft fastened to one end of a shaft mounting.

2. Description of the Related Technology

German Published Application 1 093 754 discloses a parting tool with a mechanism located in front of the blade to press the seam apart and to guide the parting tool in the uncut part of the seam and having a configuration such that a lateral cut into the fabric is prevented. The pressing apart of the seam and the tensioning of the threads of the seam is still effective in the part of the parting tool at which the threads run up against the blade, whereby the threads are guided to the blade in a manner such that the drawing cut desired is obtained. The parting tool is simple enough so that fundamentally only one tine is required.

German Patent 32 31 934 discloses a combination tool for the parting of fabric seams and the removal of threads and parts of threads. The parting tool shaft exhibits a cutting tool at one end and a pair of tweezers at its other end, which may be extended from and retracted into a casing. The casing length therefore corresponds to the shaft length with its two tools located at the ends of the shaft. When not in use, both tools are retracted into the casing. It is not possible to further reduce the size of the combination tool.

U.S. Pat. No. 2,710,448 discloses a cutting tool that may be extended and retracted. The smallest length of the tool therefore corresponds to the size of the casing. No further diminution is possible.

It is known from the general state of the art to reduce the size of small tools, for example, pocket knives, by making the blades pivotable at their ends. The back sides of the blades protrude slightly from the casing, so a notch in the blade may be engaged by a finger nail, a coin or the like to fold the blades out of the knife casing. This procedure is often difficult, particularly if the tool has not been used for a period of time; it is then very difficult to open.

SUMMARY OF THE INVENTION

It is an object of the invention to provide a parting tool of the aforementioned type, which may be reduced to a minimum size, when not in use, and having tools securely lodged in a casing.

This object may be attained according to the invention by providing a parting tool including a shaft holder with a cutting blade shaft at one end of the shaft holder and a pressure surface oriented perpendicular to the cutting blade shaft, which is located at the other end of the shaft holder. A rotation axle may be located at a defined distance in front of the pressure surface and aligned perpendicularly to the blade. The rotation axle may be rotatably mounted in the lateral surfaces of a casing open within the pivoting range of the shaft mounting. The specially designed pressure surface, which is provided with fluting, serves to move the blade together with its shaft into both its working and rest position in a simple manner.

The location of the pressure surface used for actuation at a defined distance from a rotation axle of the shaft mounting results in a pivot lever, so that the parting tool may be folded out and in very easily.

According to one embodiment of the invention, the upper edge of the casing has a recess, in which the pressure surface is supported in the working position of the parting tool, flush with the upper edge. The casing thus forms an actuating handle for the parting tool, without interference by the pressure surface.

The recess in the casing upper edge in this embodiment advantageously has a bevel sloping toward the lateral surfaces, so that a comfortable point of attack is provided for moving under the pressure surface and pivoting in the blade with its tines.

The outer surface of the pressure surface is conveniently provided with fluting.

A stop is located within the casing to serve as the terminal point abutment for the parting tool shaft in the pivoted in or rest position.

According to the invention the stop may be a spring elastic element, which cooperates with the lower and rear rounded ends of the shaft mounting in a clamping manner during the pivoting process and in the extended working position or state of the shaft.

The rear end of the shaft mounting may have a groove or notch which is engaged by a cam or nose provided on the stop, in the terminal position of the shaft mounting. This results in a secure hold for the working position, so that accidental pivoting is possible only with the application of a larger force.

The rotation axle in the shaft mounting is located in an advantageous manner at a distance of about 2/3 of the total length of the parting tool, measured from the point of the long tine to the end of shaft mounting, thereby obtaining both a favorable lever for the extension and retraction process and a minimum length of the entire parting tool in the folded position.

Each of the outer walls of the casing include a recess to receive the ends of the rotation axle and hold the parting tool, so that the working tool is well secured in the hand during the working process.

DETAILED DESCRIPTION OF THE PREFERRED EMBODIMENT

Figure 1:
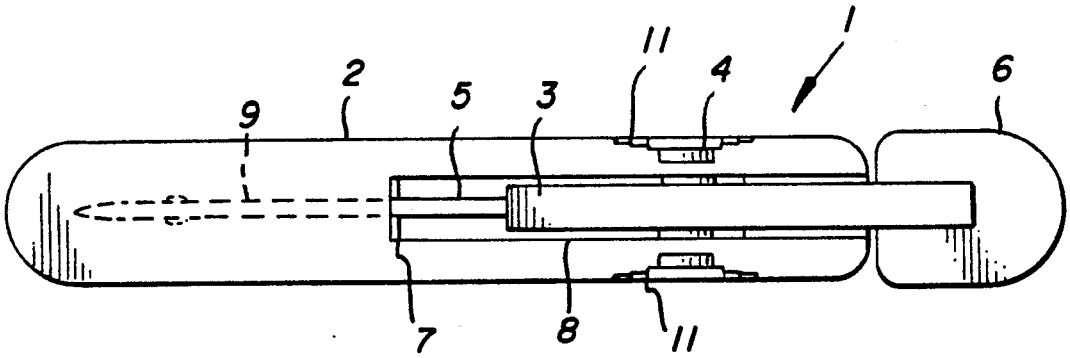
FIG. 1 shows the parting tool in the closed state from below.

FIGS. 1–4 show the complete parting tool 1 including a casing 2, a shaft mounting 3 rotatably supported around axles 4. A cutting blade 9 is fastened with its shaft 5 to one end of shaft mounting 3. A pressure surface 6 may be provided at the other end of shaft mounting 3 to carry out the in- and out-pivoting of the cutting blade 9 with its shaft 5 and shaft mounting 3.

FIG. 1 shows the parting tool 1 in the pivoted-in state from below. Casing 2 is closed on one side to limit 7 to receive cutting blade 9. For the pivoting motion of shaft mounting 3, casing 2 is provided with bilateral slot shaped opening 8.

Figure 2:
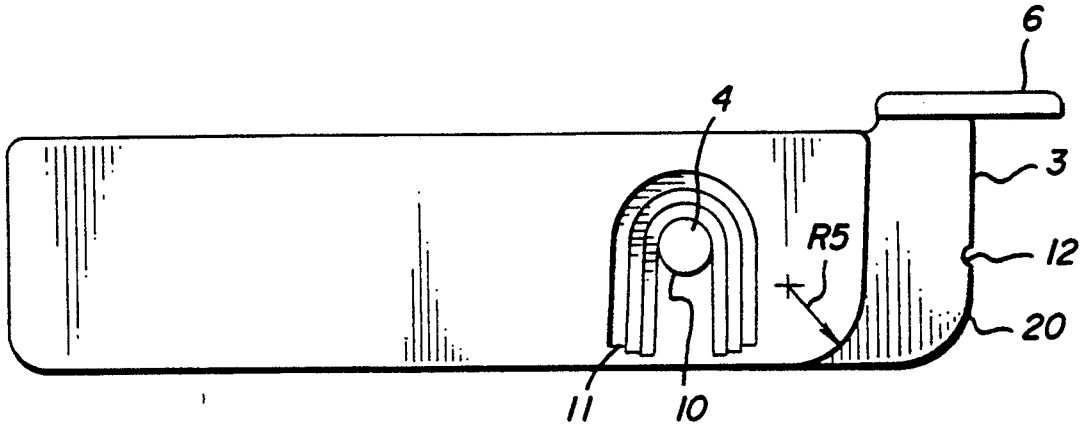
FIG. 2 shows the parting tool in the closed state in a lateral elevation.

FIG. 2 shows the parting tool in a lateral elevation and in the folded state of the cutting blade 9 as in FIG. 1. A holding bearing 10 may be provided for the axle 4 of the shaft mounting 3. An offset recess 11 in the form of a step is located around holding bearing 10 on both sides of the casing. These recesses serve to receive the tips of the index finger and thumb of a person working the parting tool 1. This provides a good hold and guidance of the parting tool.

A notch 12 may be located under the pressure surface 6 at the outer end of the shaft mounting 3. In the open working state of the parting tool 1, when the shaft mounting 3 pivoted in, notch 12 engages a spring elastic element 14 (see FIGS. 3 and 5), thereby immobilizing shaft mounting 3 for the working process. Shaft mounting 3 may also exhibit a rounded rear end 20.

Figure 3:
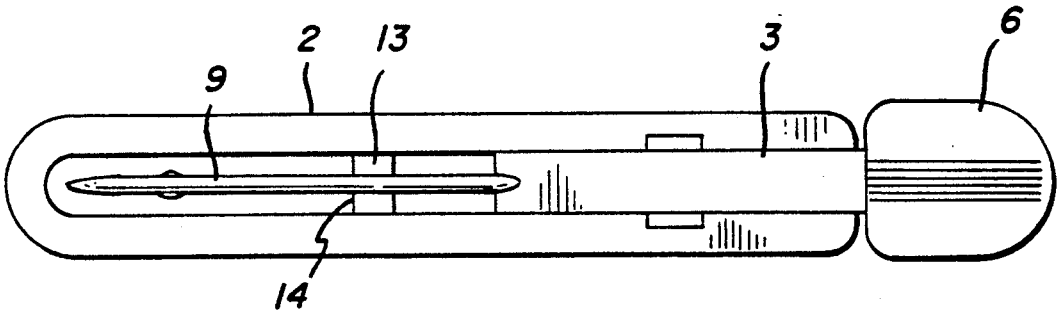
FIG. 3 shows the parting tool in the closed state in a top elevation.

FIG. 3 shows the parting tool, in the closed state as in FIGS. 1 and 2, in a top elevation.

Figure 4:
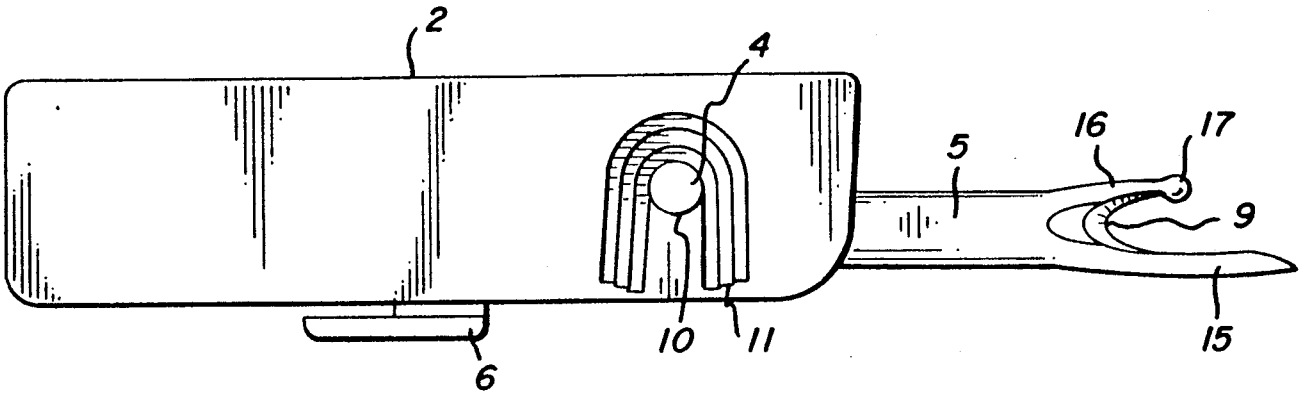
FIG. 4 shows the parting tool in the opened state in a lateral elevation.

FIG. 4 shows the parting tool 1 in a lateral elevation as in FIG. 2, but with the cutting blade 9 pivoted out in the working position. The shaft mounting 3 is located within the casing 2, with the pressure surface 6 slightly protruding from the casing in this embodiment, so that it may be readily gripped for the pivoting motion. In a further embodiment (See FIG. 15), the upper edge of the casing exhibits a recess, in which the pressure surface 6 is supported flush with the upper edge of the casing, in the working position of parting tool 1.

The head of the parting blade shaft 5 is provided with an arc-shaped cutting blade 9 located between two tines 15, 16 of unequal length to effect the cut. The long tine 15 may have a thorn-like point and the short tine 16 may have a spherical thickening 17 above the blade. The tines 15, 16 pass into the shaft 5, which is fastened to one end of shaft mounting 3.

Figure 5:
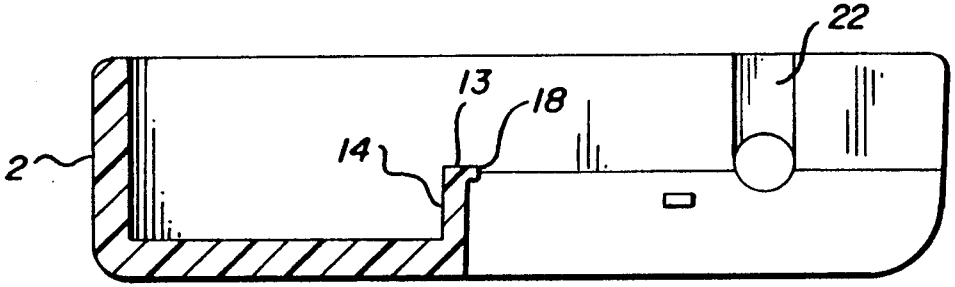
FIG. 5 shows the casing of the parting tool without the cutting blade in a longitudinal section.

FIG. 5 shows casing 2 of parting tool 1 in a longitudinal section without a built-in shaft mounting 3. A stop 13 is integrally joined with casing 2. Stop 13 has a spring-elastic configuration at its upper end and exhibits a nose 18 which cooperates with the notch 12 in shaft mounting 3 (FIG. 2), when the shaft mounting is in the casing 2 according to FIG. 4. A recess 22 is provided in both internal walls of the casing 2. These recesses serve to guide the axle 4 of the shaft mounting into the holding bearing 10 during assembly.

Figure 6:
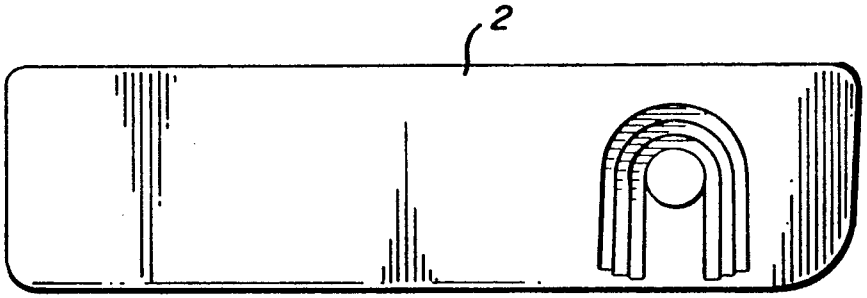
FIG. 6 shows the casing of the parting tool without the cutting blade in a lateral elevation.

FIG. 6 shows a lateral elevation of casing 2, again without a built-in shaft mounting 3.

Figure 7:
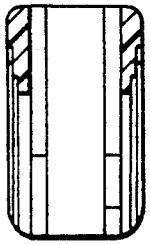
FIG. 7 shows the pressure surface from below.
Figure 8:
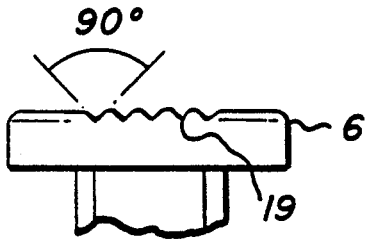
FIG. 8 shows the pressure surface in a lateral elevation.
Figure 9:
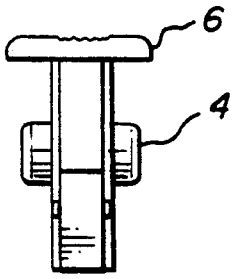
FIG. 9 shows the shaft mounting with the axle and the pressure surface from behind.

FIGS. 7, 8 and 9 show pressure surface 6 in a top elevation (FIG. 7), a lateral elevation (FIG. 8) and in a cross section (FIG. 9). As seen in FIG. 8, the surface of pressure surface 6 has a fluting 19, thereby appreciably facilitating its manipulation.

Figure 10:
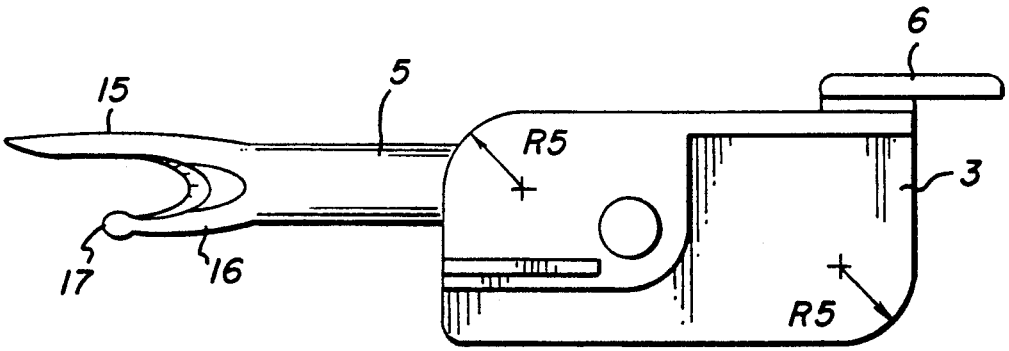
FIG. 10 shows the shaft mounting with the shaft and the two tines in a lateral elevation.
Figure 11:
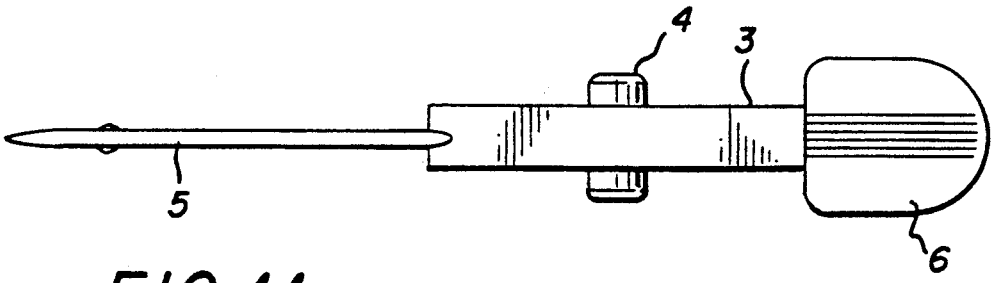
FIG. 11 shows the shaft mounting with the shaft and the tines in a top elevation.

FIG. 10 shows shaft mounting 3 with tool shaft 5 and two tines 15, 16, without a casing, in a lateral elevation. Tine 15 may exhibit a thorn-like point, and tine 16 may exhibit a spherical thickening 17. FIG. 11 shows the same shaft mounting in a top elevation.

Figure 12:
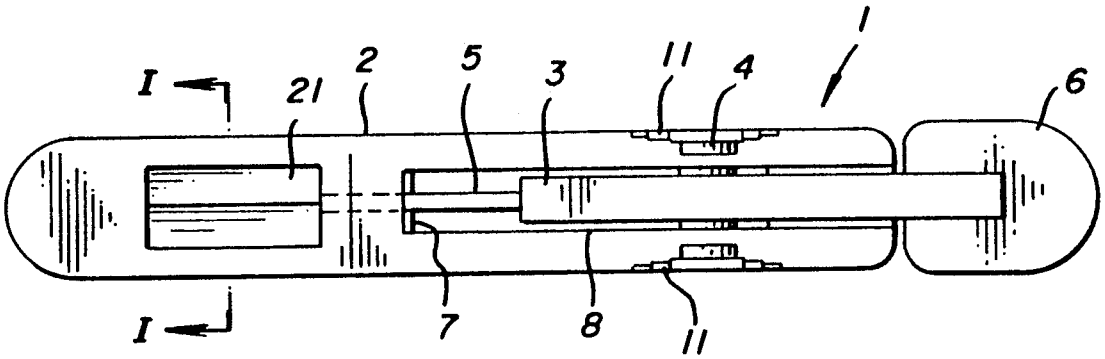
FIG. 12 shows the upper edge of the casing including the bevel.
Figure 13:
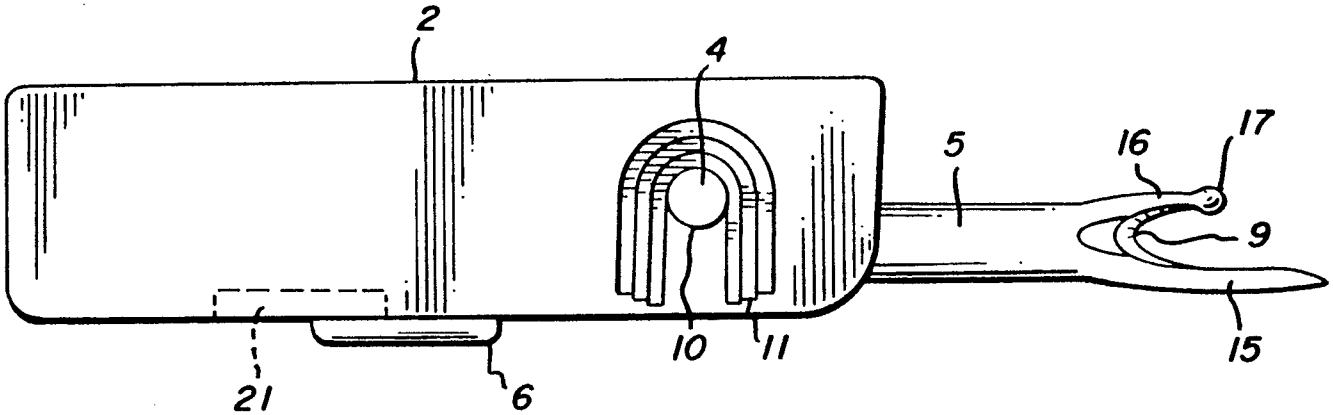
FIG. 13 shows the parting tool in the working position with the pressure surface in abutment with the upper edge of the casing.
Figure 16:
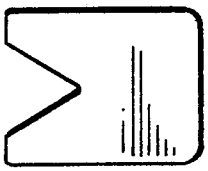
FIG. 16 shows a sectional view of the parting tool casing along the line I—I in FIG. 12.
Figure 14:
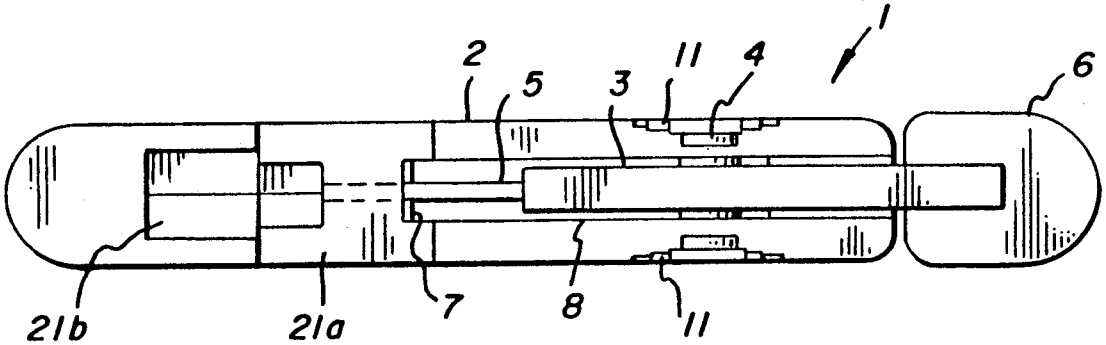
FIG. 14 shows the upper edge of the casing including the bevel according to another embodiment of the invention.
Figure 15:
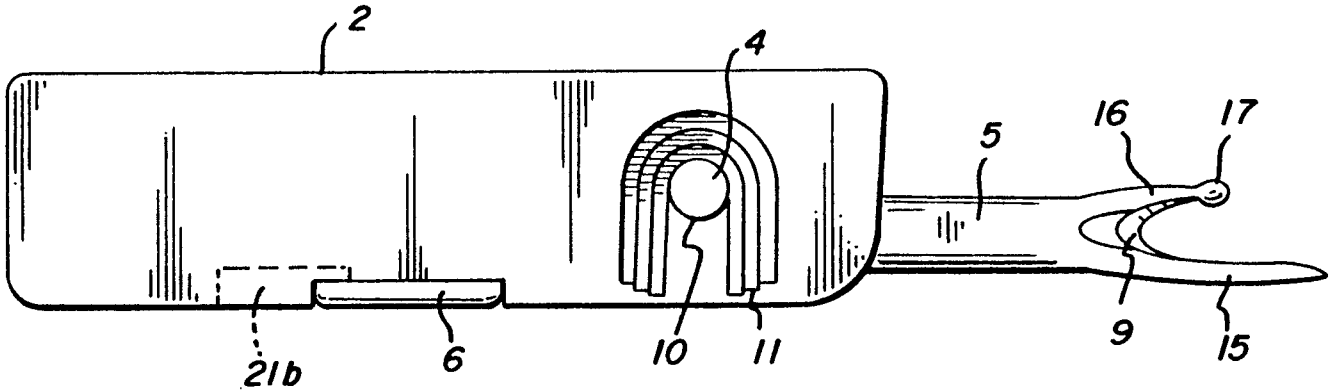
FIG. 15 shows the parting tool, according to another embodiment of the invention, in the working position with the pressure surface supported flush on the upper edge of the casing.

FIGS. 12–15 show additional embodiments of the invention. FIGS. 12 and 13 show an embodiment of the parting tool, wherein the upper edge of the casing may include a recess or bevel 21 sloping toward the lateral surfaces of casing 2 and extending below the surface of the casing upper edge. According to the embodiment set forth in FIGS. 12 and 13, when parting tool is in the working position, pressure surface 6 is supported by and in abutment with the casing upper edge. FIGS. 14 and 15 show another embodiment of the invention, wherein pressure surface 6 is located flush with the casing upper edge. Thus, the casing forms an actuating handle for the parting tool and the pressure surface does not interfere with the operation of the parting tool. According to the embodiment shown in FIGS. 14 and 15, casing 2 exhibits a recess 21*a* and a bevel 21*b*.

According to both embodiment bevel 21 or 21*b*, respectively, is located beneath pressure surface 6 so the user may place a finger or implement in bevel 21 or 21*b*, respectively, to facilitate returning the parting tool from the working position to the closed or rest position.

The shaft mounting 3 may be introduced in a simple manner into the casing 2. The lateral walls of the casing are elastic and therefore hold the axle 4 in a clamping fashion.

The parting tool according to the invention makes possible, together with a minimal length in the folded state of the cutting blade, the safe and protected containment of the sensitive, pointed and thus dangerous tool and the rapid and simple unfolding of the shaft mounting. The parting tool according to the invention has a single part, so that no protective cap can be lost, and it is an integral component of the tool.

The illustrated embodiments are shown by way of example. The spirit and scope of the invention is not to be restricted by the embodiments shown.

What is claimed is:

1. A parting tool comprising:

a casing;

a cutting blade shaft having at least an arc-shaped cutting blade located between two tines of unequal length;

a shaft holder having at least a pressure surface located at one end and a rotation axle rotatably supported by lateral surfaces of said casing; said cutting blade shaft fastened to said shaft holder;

a recess provided in an interior portion of each of said lateral surfaces of said casing;

for guiding said rotation axle into said casing during assembly of said casing and said shaft holder.

2. A parting tool according to claim 1, wherein an upper edge of said casing has at least a recess and is configured so said pressure surface is supported flush with said upper edge, when said parting tool is in a working position.

3. A parting tool according to claim 2, wherein said recess in said casing upper edge is a bevel sloping toward the lateral surfaces of said casing and extending below said pressure surface.

4. A parting tool according to claim 1, wherein an outer surface of said pressure surface has at least fluting.

5. A parting tool according to claim 1, further comprising a stop located inside said casing.

6. A parting tool according to claim 5, wherein said stop is a spring elastic element configured to cooperate in a clamping manner with said shaft holder.

7. A parting tool according to claim 6, wherein said shaft holder has at least a groove configured to engage a nose located on said stop.

8. A parting tool according to claim 5, wherein said shaft holder has at least a groove configured to engage a nose located on said stop.

9. A parting tool according to claim 5, wherein said stop is configured to limit the rotation of said cutting blade shaft.

10. A parting tool according to claim 5, wherein said shaft holder has at least a notch configured to engage a nose located on said stop.

11. A parting tool according to claim 1, wherein said rotation axle of said shaft holder is located about $\frac{2}{3}$ of the total length of the parting tool measured from a tip of one of said tines to an end of said shaft holder.

12. A parting tool according to claim 1, wherein outer walls of said casing each has at least an offset recess configured to receive an end of said rotation axle.

13. A parting tool according to claim 1, wherein said casing is configured so said pressure surface is located above and spaced apart from an upper edge of said casing, when said parting tool is in a working position.

14. A parting tool according to claim 1, wherein said rotation axle of said shaft holder is located about $\frac{2}{3}$ of the total length of said parting tool measured from a tip of one of said tines to a distal end of said shaft holder.

15. A parting tool according to claim 1, further comprising a plurality of stepped recesses, wherein each of said stepped recesses is located in an outer wall of said casing.

16. A parting tool comprising:

a casing;

a cutting blade element having at least an arc-shaped cutting blade located between two tines of unequal length; and a holder having at least a pressure surface and a rotation axle rotatably supported by lateral surface of said casing; said cutting blade element fixedly connected to said holder;

a recess provided in an interior portion of each of said lateral surfaces of said casing for guiding said rotation axle into said casing during assembly of said casing and said shaft holder.

17. A parting tool according to claim 16, wherein said cutting blade element further comprises:

a shaft connecting said cutting blade and tines to said holder; one of said tines having at least a pointed end, the other of said tines having at least a spherical thickening.

18. A parting tool according to claim 16, wherein a cutting edge of said cutting blade defines a cutting plane, said pressure surface is oriented substantially perpendicular to the cutting plane, and said rotation axle is oriented substantially perpendicular to the cutting plane.

19. A parting tool according to claim 16, further comprising:

a stop connected to said casing and having at least a nose, said holder having at least a groove, said stop configured to limit the rotation of said holder and said cutting blade element, when said parting tool is in a rest position, said stop further configured so said nose engages said groove in said holder, when said parting tool is in a working position.

20. A parting tool according to claim 16, further comprising:

an elastically deformable stop connected to said casing; said stop configured to elastically deform and engage said holder, when said parting tool is placed in a working position.

* * * * *